United States Patent [19]

Caldwell

[11] 4,136,878

[45] Jan. 30, 1979

[54] BOARD GAME APPARATUS

[76] Inventor: Ben L. Caldwell, 7640 S. Vernon Ave., Chicago, Ill. 60619

[21] Appl. No.: 795,967

[22] Filed: May 11, 1977

Related U.S. Application Data

[63] Continuation of Ser. No. 695,580, Jun. 14, 1976, abandoned.

[51] Int. Cl.[2] ..... A63F 3/00

[52] U.S. Cl. ..... 273/237; 273/142 B

[58] Field of Search ..... 273/237, 238, 142 B, 273/141 A, 142

[56] References Cited

U.S. PATENT DOCUMENTS

| | | | |
|---|---|---|---|
| 1,328,390 | 1/1920 | Nugent | 273/249 |
| 2,333,002 | 10/1943 | Goloborodko | 273/237 |
| 3,210,081 | 10/1965 | Rapaport | 273/141 A |
| 3,232,622 | 2/1966 | Lambert | 273/141 A |
| 3,414,264 | 12/1968 | Schriber | 273/246 |
| 3,512,782 | 5/1970 | Gessin | 273/142 R |
| 3,604,709 | 9/1971 | Svetz | 273/241 |

*Primary Examiner*—Anton O. Oechsle
*Assistant Examiner*—Harry G. Strappello

[57] ABSTRACT

A toy amusement device including a rotatable disc and a magnetizable gameboard for receiving a plurality of magnetic pegs which are moved sequentially on a gridwork printed on the gameboard in response to a corresponding indication provided by the rest position of the disc. The disc is rotated by an electric motor operated by a push button switch. Interposed between the motor and disc is a ball-bearing wheel having an outer race drivingly connected to the disc for continuing the rotation of the disc after the switch is opened to increase the chance factor involved in determining the rest position of the disc.

9 Claims, 2 Drawing Figures

BOARD GAME APPARATUS

This is a continuation, of application Ser. No. 695,580 filed June 14, 1976 now abandoned.

BACKGROUND OF THE INVENTION

This invention relates to a toy amusement device.

Games of chance are popular, but usually involve complex mechanical and/or electrical components necessitating high maintenance and relatively high costs of fabrication. This invention provides a toy employing a minimum number of inexpensive components which operates on a chance principle to provide amusement for and to hold the interest of a child for a protracted period of time.

SUMMARY OF THE INVENTION

The present invention provides a portable self-powered rotational toy or game apparatus which includes a rotational member and a fixed or stationary member, one of which defines an indicator and the other of which defines a plurality of indices. The rotational member is driven by a battery powered electric motor contained in a housing to which it is mounted and controlled by a manually operable switch means, which is connected to the housing by a length of flexable electric cord so that it and control of the apparatus may be conveniently passed between players positioned about the apparatus.

In accordance with this invention, a rotating disc driven by an electric motor is provided. Rotation of the disc is obtained through use of a push button switch. A plurality of different colored pads are located about the periphery of the disc. When the rotation of the disc is completed, one of the colored pads will be juxtaposition to an indicator peg. The player whose preselected color is indicated moves a peg across a gameboard grid from a "start" position toward a "finish" position.

The pegs are provided with a magnetic tip and are moved on a game board which is formed from magnetizable material. Each peg is color-coded to correspond to one of the colors on the rotatable disc.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
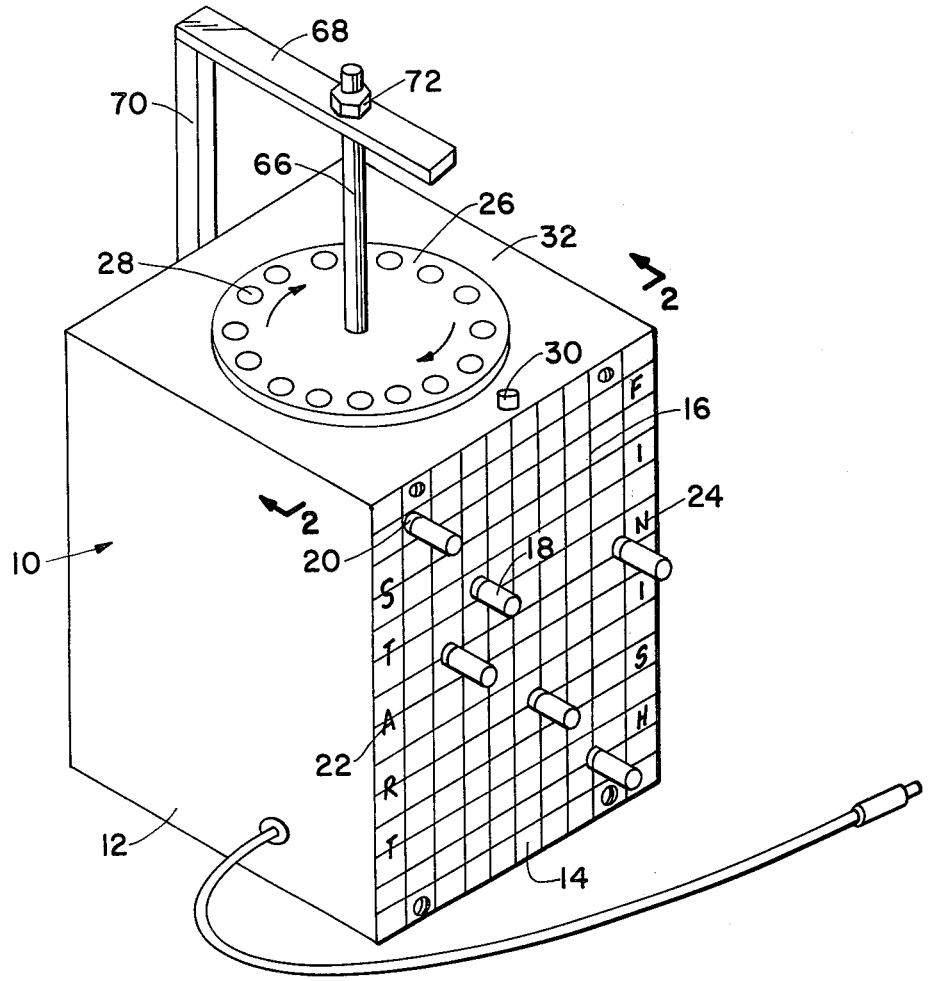
FIG. 1 is a perspective view of the toy amusement device of the present invention.
Figure 2:
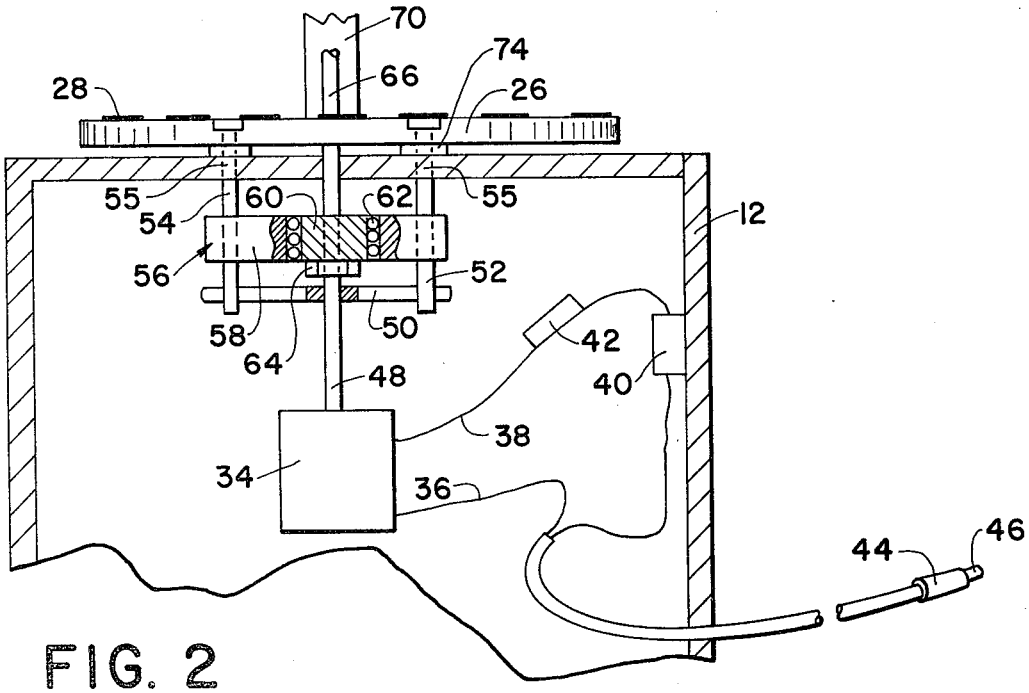
FIG. 2 is a partial cross-sectional view taken substantially along the plane indicated by lines 2—2 of FIG. 1.

Referring now in detail to the drawing, wherein like numerals indicate like elements throughout the several views, a toy amusement device 10 is illustrated in FIGS. 1 and 2. The device 10 constitutes a portable self-powered electric rotational toy.

Amusement device 10 includes a housing or box 12 having a removable cover 14 connected to box 12 by screwing. Cover 14 is made from magnetizable material and includes a gameboard gridwork 16. The number of horizontal rows on gridwork 16 corresponds to the number of pegs 18 provided with amusement device 10. Each peg 18 is color-coded with a different color and includes a magnetic tip 20 so it can be attached to the gameboard gridwork 16 on cover 14.

Suitable indicia 22 and 24 spelling the words "START" and "FINSIH" are imprinted on cover 14 to indicate the direction of movement of pegs 18 in the horizontal rows of gridwork 16. In FIG. 1, this direction is from left to right. The number of columns in gridwork 16 is variable.

Pegs 18 are moved by two or more players in accordance with a chance apparatus including a rotatable member, or disc 26 having a plurality of indicia, in this case being different colored felt pads 28 or the like affixed to disc 26 about its periphery. The colored pad 28 which comes to rest adjacent to an indicator peg 30 fixed to top surface 32 of box 12 dictates which colored peg 18 is moved horizontally square by square across gameboard gridwork 16. The first player who reaches the "FINISH" column is declared the winner.

Disc 26 is rotated by an electric motor 34 electrically connected by wires 36, 38 in series with a electric storage battery 40, horn 42 and push button switch 44, exterior of box 12. Motor 34 is activated by depression of switch button 46 and deactivated when button 46 is released. Horn 42 serves as electric powered means for generating sound to and emits a beeping sound during activation of motor 34 to indicate that disc 26 is in motion and to increase the excitement of the chance play. The switch 46 and connecting flexable cord allow for a number of players to be positioned about the apparatus 10 and to play in sequence by passing the switch 46 between them.

Motor 34 has a drive shaft 48 drivingly connected to a lower wheel 50, which receives therethrough a pair of elongated bolts 52, 54 whose heads are countersunk within disc 26. Rotation of wheel 50 will rotate disc 26 through the medium of bolts 52, 54, which move in annular slot 55 in top surface 32 of box 12.

In order to increase the length of spin of disc 26 after switch button 46 is released, to increase the chance characteristics of the game, a ball-bearing wheel 56 is provided having an outer race 58 receiving bolts 52, 54 therethrough so that outer race 58 will continue in motion after motor 34 is shut down to rotate bolts 52, 54 and spin disc 26 until friction and inertia overcome its rotational movement. The outer race 58 of wheel 56 is connected to inner race 60 by ball-bearings 62. Inner race 60 is fixed by a nut 64 to one end of a stationary spindle 66 which extends through the center of disc 26 and is connected to an arm 68 of a bracket 70 mounted on box 12, by a nut 72, which threadedly receives the other end of spindle 66. Washers 74 space disc 26 from the top surface 32 of box 12.

I claim:

1. An amusement device comprising:

a housing, a gameboard on a surface of said housing receiving a plurality of pegs which are manually moved sequentially on said gameboard from one position to another, and chance apparatus on said housing for determining which of said pegs is to be moved on said gameboard, said chance apparatus including a rotatable disc having a plurality of indicator means spaced about its periphery and each corresponding to one of said pegs, a stationary member adjacent said disc providing a reference site fo selecting one of said indicator means on said disc which stops in juxtaposition thereto, and means for rotating said disc, said means including an electric motor, switch means movable from an open to a closed position for electrically operating said motor, means for drivingly connecting said motor to said disc, and means for continuing the rotation of said disc after said switch means is opened to increase the element of chance provided by said apparatus.

2. An amusement device in accordance with claim 1 wherein said means for continuing the rotation of said disc includes a ball-bearing wheel having a stationary inner race and a rotatable outer race between said motor and disc.

3. An amusement device in accordance with claim 1 wherein said switch means includes a push button switch.

4. An amusement device in accordance with claim 1 wherein said gameboard is formed from magnetizable material and said pegs are magnetic.

5. An amusement device in accordance with claim 1 wherein the indicator means on said rotatable disc include different colored pads spaced about the periphery of said disc, and said pegs are each of a different color corresponding to one of the colors of said pads.

6. An amusement device in accordance with claim 1 wherein said gameboard includes a gridwork imprinted thereon on which said pegs are sequentially moved.

7. An amusement device in accordance with claim 1 including a horn electrically connected between said switch means and electric motor for emitting a sound when said motor is operated by said switch means.

8. An amusement device in accordance with claim 1 wherein said means drivingly connecting said motor to said disc includes a pair of bolts connected to said disc extending downwardly through an annular opening in the top of said housing, and a wheel connected to said motor receiving said bolts therethrough.

9. A portable self-powered rotational toy apparatus comprising:

a housing;

a rotational member mounted to said housing and a stationary member mounted to said housing, one of said members defining an indicator and the other member defining a plurality of different indicia, said members being mounted and rotational relative to one another so that said indicator will indicate one of the plurality of indicia after rotation of the rotary member stops;

an electric motor mounted to said housing and coupled to drive said rotating member;

an electric storage battery means mounted in said housing, for serving as the source of power for the electric motor;

a manually operable switch means operably associated with said battery and said motor for controlling said motor such that the rotational member may be selectively rotated for a period by operating the switch means and afterward allowed to stop to indicate one of the indicia, said switch means including a switch connected by a length of electric cord to the housing whereby control of the apparatus may be had by one of a number of players positioned about the housing, without having to touch the housing and the switch may be easily passed to other players and wherein sound generating means are provided in the housing which are controlled to sound whenever the motor is energized.

* * * * *